US008667644B1

(12) United States Patent
Marion

(10) Patent No.: US 8,667,644 B1
(45) Date of Patent: Mar. 11, 2014

(54) VACUUM CLEANER ATTACHMENT

(76) Inventor: Greg Marion, Plymouth, MN (US)

( * ) Notice: Subject to any disclaimer, the term of this patent is extended or adjusted under 35 U.S.C. 154(b) by 500 days.

(21) Appl. No.: 12/913,478

(22) Filed: Oct. 27, 2010

(51) Int. Cl.
*A47L 9/02* (2006.01)
*A47L 5/34* (2006.01)

(52) U.S. Cl.
USPC ..... 15/415.1; 15/360

(58) Field of Classification Search
USPC ..... 15/359, 360, 362, 415.1
IPC ..... A47L 5/34,9/02
See application file for complete search history.

(56) References Cited

U.S. PATENT DOCUMENTS 1,899,107 A * 2/1933 Riebel, Jr. ..... 15/360
1,899,108 A * 2/1933 Riebel, Jr. ..... 15/360
1,899,423 A * 2/1933 Riebel, Jr. ..... 15/360
3,654,661 A 4/1972 Scott
3,908,223 A 9/1975 Brooks et al.
3,949,442 A 4/1976 Chandler
4,334,337 A 6/1982 Miller et al.
4,570,286 A 2/1986 Ross
4,823,430 A 4/1989 Yonkers et al.
6,490,755 B2 12/2002 Paterson et al.
6,499,183 B1 12/2002 Paterson et al.
7,533,440 B2 5/2009 Paterson et al.
2004/0255411 A1 12/2004 Grey
2007/0245513 A1 10/2007 Hobbs et al.
2008/0313846 A1 12/2008 Steffen et al.
2009/0100636 A1 4/2009 Sohn et al.
2010/0083460 A1 4/2010 Beskow et al.

* cited by examiner

*Primary Examiner* — David Redding

(57) ABSTRACT

A vacuum cleaner attachment is provided for vacuuming without the vacuum cleaner attachment becoming stuck to a surface being cleaned during use. The vacuum cleaner attachment includes a body portion having a top and a perimeter wall extending from the top to define an interior space. A vacuum connection portion extends from the top of the body portion. The vacuum connection portion is in environmental communication with the interior space of the body portion. The vacuum connection portion is designed for coupling to a vacuum cleaner tube to provide suction to the interior space. A first wheel is coupled to the body portion. The first wheel extends downwardly from the body portion such that the first wheel is designed for supporting the body portion in spaced relationship to a supporting surface.

18 Claims, 4 Drawing Sheets

VACUUM CLEANER ATTACHMENT

BACKGROUND OF THE DISCLOSURE

Field of the Disclosure

The disclosure relates to vacuum cleaner attachments and more particularly pertains to a new vacuum cleaner attachment for vacuuming without the vacuum cleaner attachment becoming stuck to a surface being cleaned during use.

SUMMARY OF THE DISCLOSURE

An embodiment of the disclosure meets the needs presented above by generally comprising a body portion having a top and a perimeter wall extending from the top to define an interior space. A vacuum connection portion extends from the top of the body portion. The vacuum connection portion is in environmental communication with the interior space of the body portion. The vacuum connection portion is designed for coupling to a vacuum cleaner tube to provide suction to the interior space. A first wheel is coupled to the body portion. The first wheel extends downwardly from the body portion such that the first wheel is designed for supporting the body portion in spaced relationship to a supporting surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
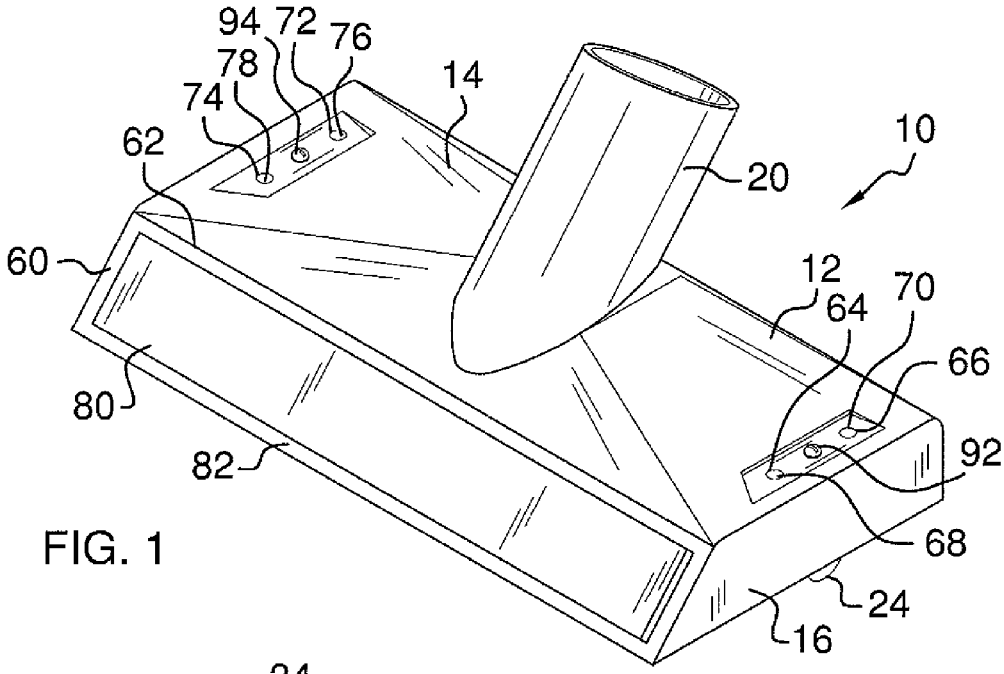
FIG. 1 is a top front side perspective view of a vacuum cleaner attachment according to an embodiment of the disclosure.
Figure 2:
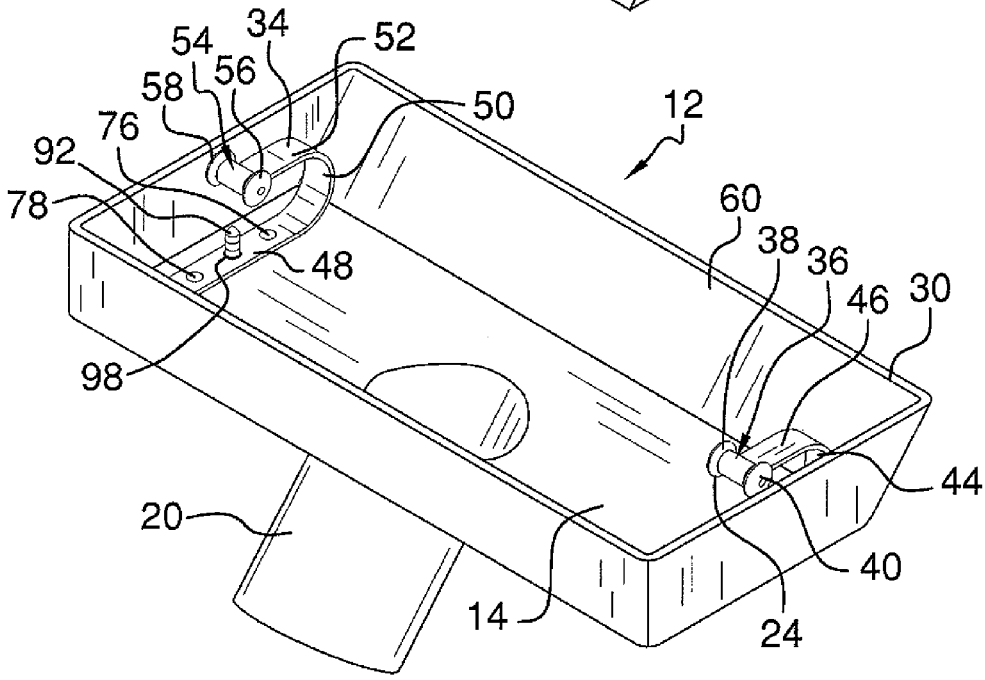
FIG. 2 is a bottom rear side perspective view of an embodiment of the disclosure.
Figure 3:
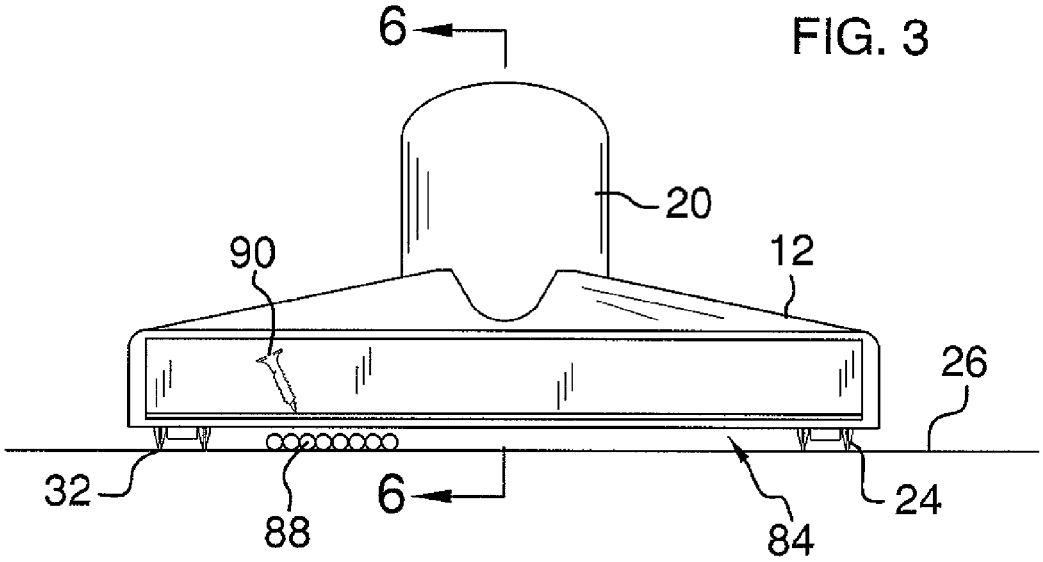
FIG. 3 is a front view of an embodiment of the disclosure.
Figure 4:
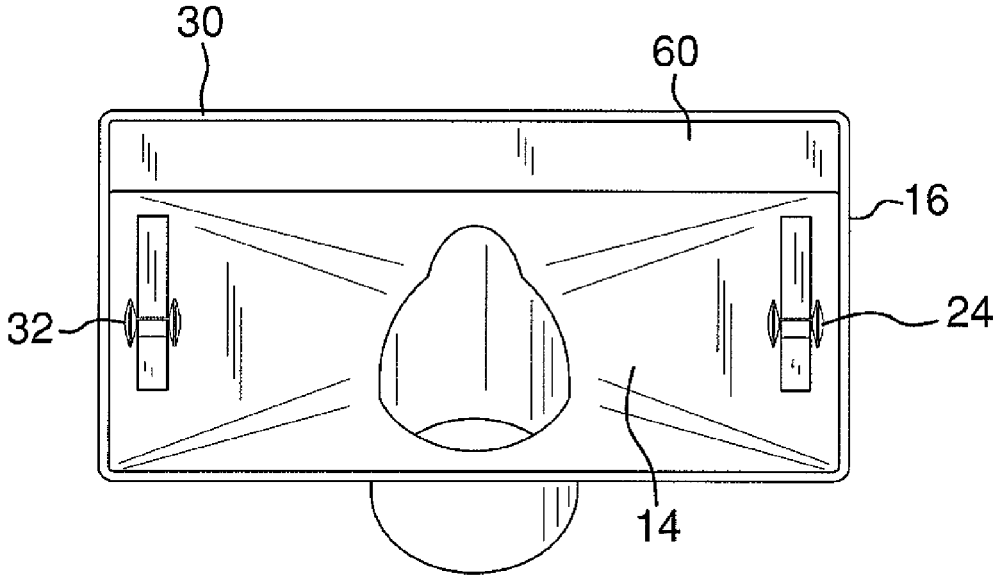
FIG. 4 is a bottom view of an embodiment of the disclosure.
Figure 5:
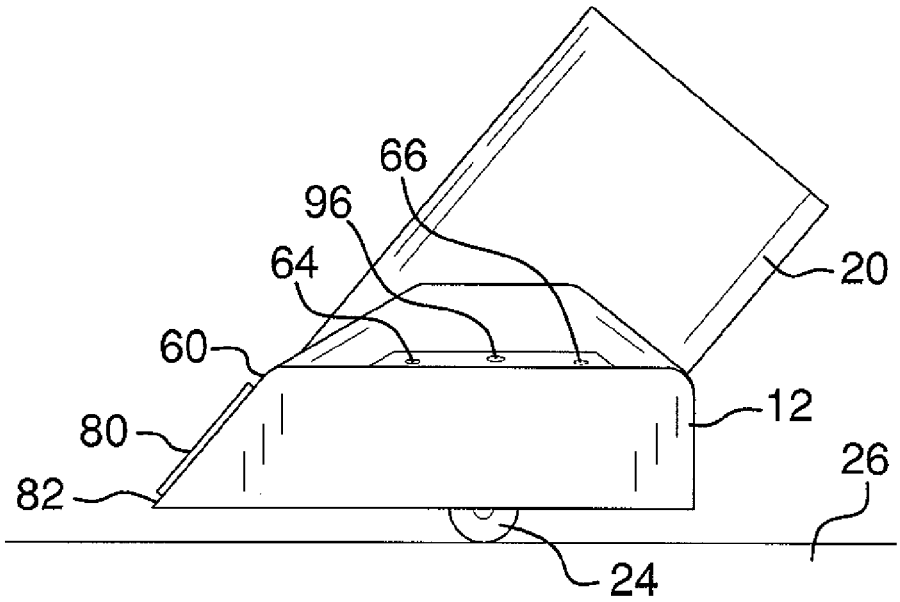
FIG. 5 is a side view of an embodiment of the disclosure.
Figure 6:
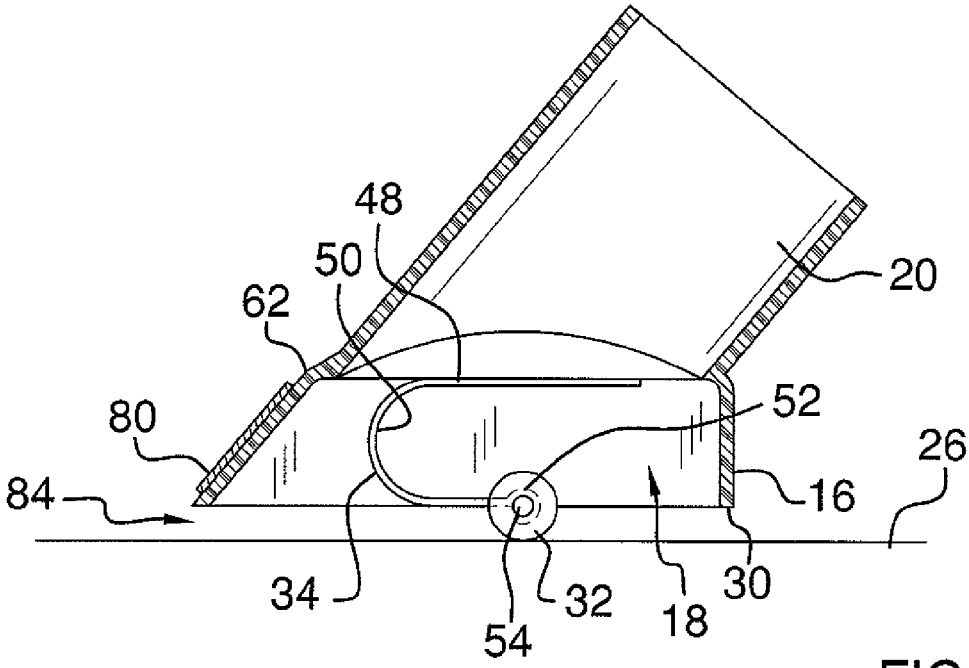
FIG. 6 is a cross-sectional view of an embodiment of the disclosure taken along line 6-6 of FIG. 3.
Figure 7:
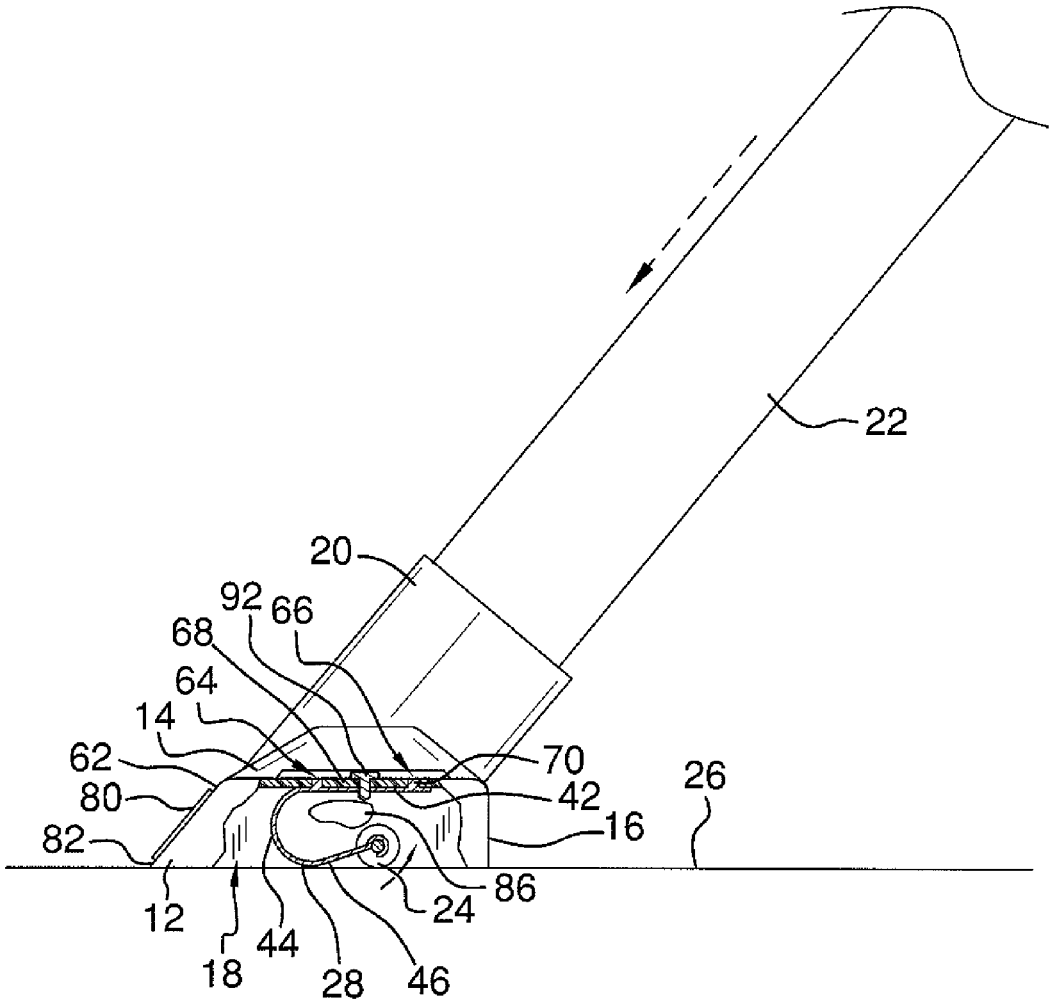
FIG. 7 is a partial cut-away side view of an embodiment of the disclosure in use.

With reference now to the drawings, and in particular to FIGS. 1 through 7 thereof, a new vacuum cleaner attachment embodying the principles and concepts of an embodiment of the disclosure and generally designated by the reference numeral 10 will be described.

As best illustrated in FIGS. 1 through 7, the vacuum cleaner attachment 10 generally comprises a body portion 12 having a top 14 and a perimeter wall 16 extending from the top 14 to define an interior space 18. A vacuum connection portion 20 extends from the top 14 of the body portion 12. The vacuum connection portion 20 is in environmental communication with the interior space 18 of the body portion 12. The vacuum connection portion 20 is designed for coupling to a vacuum cleaner tube 22 to provide suction to the interior space 18. A first wheel 24 is coupled to the body portion 12. The first wheel extends downwardly from the body portion 12 such that the first wheel 24 is designed for supporting the body portion 12 in spaced relationship to a supporting surface 26.

A first wheel biasing member 28 is coupled between the first wheel 24 and the body portion 12 to bias the first wheel 24 away from the top 14 of the body portion 12. The stiffness of the first wheel biasing member 28 is sufficient to prevent the suction from the vacuum cleaner tube 22 alone from drawing the body portion 12 into contact with the supporting surface 26. However, the first wheel biasing member 28 is compressible to retract the first wheel 24 into the interior space 18 of the body portion 12. Thus, the first wheel biasing member 28 is designed for permitting a perimeter edge 30 of the body portion 12 to contact the supporting surface 26 when desired by application of downward pressure to the body portion 12 by a user.

Similarly, a second wheel 32 is coupled to the body portion 12. The second wheel 32 extends downwardly from the body portion 12 such that the second wheel 32 is designed for supporting the body portion 12 in spaced relationship to the supporting surface 26. A second wheel biasing member 34 is coupled between the second wheel 32 and the body portion 12 to bias the second wheel 32 away from the top 14 of the body portion 12. The second wheel biasing member 34 is compressible to retract the second wheel 32 into the interior space 18 of the body portion 12. Thus, the second wheel biasing member 34 is also designed for permitting the perimeter edge 30 of the body portion 12 to contact the supporting surface 26 when downward pressure is applied to the body portion 12 by the user.

The first wheel 24 includes an axle portion 36 extending between a pair of round end portions 38,40. The first wheel biasing member 28 includes a flat first wheel biasing member body connection portion 42, an arcuate first wheel biasing member medial portion 44, and a first wheel biasing member wheel connection portion 46. Likewise, the second wheel biasing member 34 includes a flat second wheel biasing member body connection portion 48, an arcuate second wheel biasing member medial portion 50, and a second wheel biasing member wheel connection portion 52. The first wheel biasing member wheel connection portion 46 coupled to the axle portion 36 of the first wheel 24. The second wheel 32 includes an axle portion 54 extending between a pair of round end portions 56,58. The second wheel biasing member wheel connection portion 52 couples to the axle portion 54 of the second wheel 32.

A front wall portion 60 of the perimeter wall 16 extends from a forward edge 62 of the top 14 of the body portion 12 at an obtuse angle. The top 14 of the body portion 12 includes a pair of first wheel biasing member connection apertures 64,66 and a first wheel central connection hole 96 extending through the top 14. The first wheel biasing member body connection portion 42 has a pair of spaced first biasing member connection posts 68,70 insertable into the pair of first wheel biasing member connection apertures 64,66 such that the first wheel biasing member 28 is held in a stable position relative to the top 14 of the body portion 12. First threaded connector 92 is coupled to the first wheel biasing member 28 through the first wheel central connection hole 96 to secure the first wheel biasing member 28. The top 14 of the body portion 12 also includes a pair of second wheel biasing member connection apertures 72,74 and a second wheel central connection hole 98 extending through the top 14. The second wheel biasing member body connection portion 48 has a pair of spaced second biasing member connection posts 76,78 insertable into the pair of second wheel biasing member connection apertures 72,74 such that the second wheel biasing member 34 is held in a stable position relative to the top 14 of the body portion 12. Second threaded connector 94 is coupled to the second wheel biasing member 34 through the second wheel central connection hole 98 to secure the second wheel biasing member 34.

A magnetic strip 80 may be coupled to an outwardly facing front surface 82 of the front wall portion 60 of the body portion 12. The magnetic strip 80 may be selectively removable from the outwardly facing front surface 82 of the front wall portion 60 if so desired.

In use, the attachment 10 is designed for facilitating cleaning of workspaces where sawdust, wood chips, or similarly shaped debris may be present. The vacuum cleaner tube 22 is attached to the vacuum connection portion 20. The body portion 12 is held in suspension over the supporting surface 26 by the biased first wheel 24 and second wheel 32. Thus, debris 88 is provided a gap 84 between the body portion 12 and the supporting surface 26 to pass through. The debris 88 is then sucked into the vacuum cleaner tube 22. The biasing of the first wheel 24 and the second wheel 32 permit the user to push down on the vacuum cleaner tube 22 urging the body portion 12 into contact with the supporting surface 26. This action permits maximized suction on larger pieces of debris 86 as may occasionally be desired. The outward biasing of the first wheel 24 and the second wheel 32 also facilitate disengagement of the body portion 12 from the supporting surface 26 when it is desired to re-establish the spacing between the body portion 12 and the supporting surface 26. The removable magnetic strip 80 may be used to pick up metallic debris 90 that the user does not wish to be sucked into the vacuum cleaner tube 22.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A vacuum cleaner attachment comprising:

a body portion having a top and a perimeter wall extending from said top defining an interior space;

a vacuum connection portion extending from said top of said body portion;

said vacuum connection portion being in environmental communication with said interior space of said body portion, said vacuum connection portion being adapted for coupling to a vacuum cleaner tube;

a first wheel biasing member being attached to said body portion; and a first wheel coupled to said first wheel biasing member, said first wheel extending downwardly from said body portion such that said first wheel is adapted for supporting said body portion in spaced relationship to a supporting surface, said first wheel biasing member being compressible to retract said first wheel into said body portion such that said first wheel biasing member permits a perimeter edge of said body portion to contact the supporting surface when downward pressure is applied to said body portion by a user, said first wheel biasing member biasing said first wheel away from said top of said body portion; and a front wall portion of said perimeter wall extends from a forward edge of said top of said body portion at an obtuse angle.

2. The vacuum cleaner attachment of claim 1, further comprising:

a second wheel coupled to said body portion, said second wheel extending downwardly from said body portion such that said second wheel is adapted for supporting said body portion in spaced relationship to the supporting surface; and a second wheel biasing member coupled between said second wheel and said body portion to bias said second wheel away from said top of said body portion.

3. The vacuum cleaner attachment of claim 2, wherein said second wheel biasing member is compressible to retract said second wheel into said body portion such that said second wheel biasing member is adapted for permitting said perimeter edge of said body portion to contact the supporting surface when downward pressure is applied to said body portion by the user.

4. The vacuum cleaner attachment of claim 1, wherein said first wheel includes an axle portion extending between a pair of round end portions.

5. The vacuum cleaner attachment of claim 1, wherein said first wheel biasing member includes a flat first wheel biasing member body connection portion, an arcuate first wheel biasing member medial portion and a first wheel biasing member wheel connection portion.

6. The vacuum cleaner attachment of claim 2, wherein said second wheel biasing member includes a flat second wheel biasing member body connection portion, an arcuate second wheel biasing member medial portion and a second wheel biasing member wheel connection portion.

7. The vacuum cleaner attachment of claim 1, further including a magnetic strip coupled to an outwardly facing front surface of said front wall portion.

8. The vacuum cleaner attachment of claim 5, further comprising:

said top of said body portion having a pair of first wheel biasing member connection apertures extending through said top; and said first wheel biasing member body connection portion having a pair of spaced first biasing member connection posts insertable into said pair of first wheel biasing member connection apertures such that said first wheel biasing member is held in a stable position relative to said top of said body portion.

9. The vacuum cleaner attachment of claim 6, further comprising:

said top of said body portion having a pair of second wheel biasing member connection apertures extending through said top; and said second wheel biasing member body connection portion having a pair of spaced second biasing member connection posts insertable into said pair of second wheel biasing member connection apertures such that said second wheel biasing member is held in a stable position relative to said top of said body portion.

10. The vacuum cleaner attachment of claim 7, wherein said magnetic strip is selectively removable from said outwardly facing front surface of said front wall portion.

11. A vacuum cleaner attachment comprising:

a body portion having a top and a perimeter wall extending from said top defining an interior space;

a vacuum connection portion extending from said top of said body portion;

said vacuum connection portion being in environmental communication with said interior space of said body portion, said vacuum connection portion being adapted for coupling to a vacuum cleaner tube;

a first wheel coupled to said body portion, said first wheel extending downwardly from said body portion such that said first wheel is adapted for supporting said body portion in spaced relationship to a supporting surface;

a first wheel biasing member coupled between said first wheel and said body portion to bias said first wheel away from said top of said body portion;

wherein said first wheel biasing member is compressible to retract said first wheel into said body portion such that said first wheel biasing member is adapted for permitting a perimeter edge of said body portion to contact the supporting surface when downward pressure is applied to said body portion by a user;

a second wheel coupled to said body portion, said second wheel extending downwardly from said body portion such that said second wheel is adapted for supporting said body portion in spaced relationship to the supporting surface;

a second wheel biasing member coupled between said second wheel and said body portion to bias said second wheel away from said top of said body portion;

wherein said second wheel biasing member is compressible to retract said second wheel into said body portion such that said second wheel biasing member is adapted for permitting said perimeter edge of said body portion to contact the supporting surface when downward pressure is applied to said body portion by the user;

wherein said first wheel includes an axle portion extending between a pair of round end portions;

wherein said first wheel biasing member includes a flat first wheel biasing member body connection portion, an arcuate first wheel biasing member medial portion and a first wheel biasing member wheel connection portion;

wherein said second wheel biasing member includes a flat second wheel biasing member body connection portion, an arcuate second wheel biasing member medial portion and a second wheel biasing member wheel connection portion;

wherein a front wall portion of said perimeter wall extends from a forward edge of said top of said body portion at an obtuse angle;

said top of said body portion having a pair of first wheel biasing member connection apertures extending through said top;

said first wheel biasing member body connection portion having a pair of spaced first biasing member connection posts insertable into said pair of first wheel biasing member connection apertures such that said first wheel biasing member is held in a stable position relative to said top of said body portion;

said top of said body portion having a pair of second wheel biasing member connection apertures extending through said top; and said second wheel biasing member body connection portion having a pair of spaced second biasing member connection posts insertable into said pair of second wheel biasing member connection apertures such that said second wheel biasing member is held in a stable position relative to said top of said body portion.

12. The vacuum cleaner attachment of claim 11, further comprising:

a magnetic strip coupled to an outwardly facing front surface of said front wall portion; and wherein said magnetic strip is selectively removable from said outwardly facing front surface of said front wall portion.

13. A vacuum cleaner attachment comprising:

a body portion having a top and a perimeter wall extending from said top defining an interior space;

a vacuum connection portion extending from said top of said body portion;

said vacuum connection portion being in environmental communication with said interior space of said body portion, said vacuum connection portion being adapted for coupling to a vacuum cleaner tube;

a first wheel coupled to said body portion, said first wheel extending downwardly from said body portion such that said first wheel is adapted for supporting said body portion in spaced relationship to a supporting surface;

a front wall portion of said perimeter wall extending from a forward edge of said top of said body portion; and a magnetic strip coupled to an outwardly facing front surface of said front wall portion.

14. The vacuum cleaner attachment of claim 13, further including a first wheel biasing member coupled between said first wheel and said body portion to bias said first wheel away from said top of said body portion, said first wheel biasing member being compressible to retract said first wheel into said body portion such that said first wheel biasing member is adapted for permitting a perimeter edge of said body portion to contact the supporting surface when downward pressure is applied to said body portion by a user.

15. The vacuum cleaner attachment of claim 14, further comprising:

a second wheel coupled to said body portion, said second wheel extending downwardly from said body portion such that said second wheel is adapted for supporting said body portion in spaced relationship to the supporting surface;

a second wheel biasing member coupled between said second wheel and said body portion to bias said second wheel away from said top of said body portion; and said second wheel biasing member being compressible to retract said second wheel into said body portion such that said second wheel biasing member is adapted for permitting said perimeter edge of said body portion to contact the supporting surface when downward pressure is applied to said body portion by the user.

16. The vacuum cleaner attachment of claim 15, wherein;

said first wheel biasing member including a flat first wheel biasing member body connection portion, an arcuate first wheel biasing member medial portion and a first wheel biasing member wheel connection portion; and said second wheel biasing member including a flat second wheel biasing member body connection portion, an arcuate second wheel biasing member medial portion and a second wheel biasing member wheel connection portion.

17. The vacuum cleaner attachment of claim 13, wherein said front wall portion of said perimeter wall extends from a forward edge of said top of said body portion at an obtuse angle.

18. The vacuum cleaner attachment of claim 13, wherein said magnetic strip is selectively removable from said outwardly facing front surface of said front wall portion.

* * * * *